US009000362B2

(12) United States Patent
Stoermer

(10) Patent No.: US 9,000,362 B2
(45) Date of Patent: Apr. 7, 2015

(54) MASS SPECTROMETRIC ION STORAGE DEVICE FOR DIFFERENT MASS RANGES

(71) Applicant: Bruker Daltonik GmbH, Bremen (DE)

(72) Inventor: Carsten Stoermer, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 13/628,748

(22) Filed: Sep. 27, 2012

(65) Prior Publication Data

US 2013/0075602 A1 Mar. 28, 2013

(30) Foreign Application Priority Data

Sep. 28, 2011 (DE) ..... 10 2011 115 195

(51) Int. Cl.
*H01J 49/42* (2006.01)
*H01J 49/00* (2006.01)
*H01J 49/06* (2006.01)

(52) U.S. Cl.
CPC ..... *H01J 49/0045* (2013.01); *H01J 49/063* (2013.01); *H01J 49/4295* (2013.01)

(58) Field of Classification Search
USPC ..... 250/292, 290, 281, 396 R
See application file for complete search history.

(56) References Cited

U.S. PATENT DOCUMENTS 6,403,955 B1 6/2002 Senko
7,126,118 B2 10/2006 Park
7,189,965 B2 * 3/2007 Franzen ..... 250/283
7,196,326 B2 3/2007 Franzen et al.
7,288,761 B2 10/2007 Collings
7,595,486 B2 9/2009 Franzen
8,080,788 B2 12/2011 Stoermer
8,164,056 B2 * 4/2012 Park et al. ..... 250/292
8,314,384 B2 11/2012 Stoermer
2008/0251715 A1 * 10/2008 Nikolaev et al. ..... 250/288
2010/0308218 A1 12/2010 Wang

FOREIGN PATENT DOCUMENTS

DE 2701395 7/1978
GB 2470664 12/2010
WO 0113100 2/2001
WO 2009/006726 1/2009

* cited by examiner

*Primary Examiner* — Kiet T Nguyen
(74) *Attorney, Agent, or Firm* — O'Shea Getz P.C.

(57) ABSTRACT

The invention relates to devices and methods for the storage of ions in mass spectrometers. The invention proposes the generation and superposition of two multipole fields of different order, independent of each other, in an RF multipole rod system. In an embodiment with eight pole rods, for example, it is thus possible to jointly store low-energy electrons in a central RF quadrupole field, which effectively acts only on electrons and holds them together radially, on the one hand, and multiply charged heavy positive ions in an RF octopole field, which effectively acts only on the ions, on the other hand, in order to fragment the positive ions by electron capture dissociation (ECD). In a different embodiment, multiply charged positive analyte ions and suitable negative reactant ions can react with each other in an octopole field by electron transfer dissociation (ETD) with a high fragmentation yield, and the fragment ions can subsequently be bundled by a transition to a quadrupole field to form a fine ion beam, which can leave the multipole rod system axially. A mixture of hexapole and dodecapole systems is also possible.

18 Claims, 6 Drawing Sheets

MASS SPECTROMETRIC ION STORAGE DEVICE FOR DIFFERENT MASS RANGES

PRIORITY INFORMATION

This patent application claims priority from German Patent Application No. 10 2011 115 195.1 filed on Sep. 28, 2011, which is hereby incorporated by reference in its entirety.

FIELD OF THE INVENTION

The invention relates to devices and methods for the storage of ions in mass spectrometers.

BACKGROUND OF THE INVENTION

The term "mass" here refers to the "charge-related mass" m/z, which is the only quantity that can be measured in mass spectrometry, and not simply the "physical mass" m. The number z is the number of elementary charges, i.e., the number of excess electrons or protons of the ion, which act externally as the ion charge. The charge-related mass is the mass fraction of the ion per excess elementary charge.

The term "ions" here refers to all charged particles; in this sense, electrons are also ions, for example, with a tiny mass of only m=1/1823 daltons.

For around three decades, RF multipole rod systems have been used both as ion storage devices and as ion guides. Particularly well known are RF quadrupole rod systems according to Wolfgang Paul with four pole rods, but hexapole and octopole rod systems are also frequently used, depending on the requirements regarding the radial bundling of the ions. The rod systems can consist of round pole rods, but for the generation of ideal fields, rods with hyperbolic shapes must be used.

The effect of the multipole systems is described by so-called "pseudopotentials", fictitious potentials which make it possible to describe the effect of inhomogeneous alternating fields on ions in a simple way. An alternating field at the tip of a wire, whose strength decreases at $1/r^2$, or an alternating field around a long wire, which decreases at 1/r, reflects both positively and negatively charged particles. This occurs because the particle oscillates in the alternating field of the wire. Irrespective of its charge, the particle experiences maximum repulsion from the wire precisely when it is at the point of its oscillation that is closest to the wire, i.e., at the point where the field strength is highest. The particle experiences maximum attraction when it is furthest away, i.e., at the point on its trajectory where the field strength is lowest. Integration over time therefore gives a repulsion of the particle, which is permanently oscillating in the RF field, away from the tip. The repulsive field obtained by integration over time is described by this fictitious "pseudopotential", which is proportional to the square of the alternating field strength. The derivative of this gives an electric "pseudo force field". For the tip of the wire, the repulsive pseudopotential decreases at $1/r^4$; for the long wire it decreases outward at $1/r^2$, but in both cases it is still inversely proportional to the mass of the ions and likewise inversely proportional to the square of the frequency. Ions of different charge-related mass m/z thus experience repulsions of different strengths; heavier ions are repelled less strongly.

If one examines the pseudopotential in the cross-section of a quadrupole rod system, it approaches zero in the axis of the rod system. The pseudopotential increases quadratically from the axis outward in all radial directions. The rotationally symmetric parabolic minimum of the pseudopotential in the cross-section forms a potential well along the axis of the rod system. Ions of low kinetic energy can oscillate harmonically in the radial direction through the potential well or they can orbit or tumble around the potential well. If a rod system such as this is filled with a collision gas at a pressure between 0.01 and 1 pascal, ions injected with a few electronvolts give up most of their kinetic energy as a result of collisions with this gas in a short period of time of only 0.1 to 10 milliseconds and collect as a thin string of ions only with thermal energy in this potential well along the axis. The collision gas is therefore also referred to as damping gas. The diameter of the ion string depends on the mutual repulsion of the ions, which opposes the centripetal force of the pseudopotential. This focusing effect can also be observed when the ions are transported through a gas-filled multipole system. This process, described already in German Patent DE 27 01 395, is now called "collision focusing".

Collision focusing is of major importance for most modern mass spectrometers. The injection of ions into a subsequent stage of a mass spectrometer, for example into a subsequent vacuum stage, ion guide or ion analyzer, almost always depends on the cross-section of the ion beam. A very fine beam cross-section, as is produced by collision focusing, is almost always advantageous. This applies for injection into a quadrupole mass filter just as it does for injection into an ion trap, and most particularly for injection into a time-of-flight mass spectrometer (OTOF), which pulses out ions of a fine ion beam by a pulser, orthogonally to the previous flight direction, into the flight path; here the good shaping of a fine primary beam is essential for the resolving power of the OTOF.

The rod systems used to guide ions are generally very long and thin so that they can concentrate the ions in a region with a very small diameter. They can then advantageously be operated with low RF voltages and form a good starting point for the subsequent ion-optical imaging of the ions. The cylindrical interior often has a diameter of only around 2 to 4 millimeters, the rods are less than a millimeter thick, and the system is 2 to 25 centimeters long. They are mainly used to guide ions through the various chambers of differential pump systems. The term "long" pole rods here should be taken to mean pole rods which are longer than the separation between opposite pole rods.

The rod systems used as collision cells for collision-induced fragmentation are usually not as slim; they usually have internal rod separations of 6 to 8, sometimes up to 12, millimeters in order to keep the ions, which diffuse laterally due to the statistically acting collisional deflection, in the collision cell. Similar considerations apply to reaction cells, in which positive and negative ions are made to react. These also require special terminations at the ends in order to keep ions of both polarities within the reaction cell.

It is known that all RF rod systems show a lower mass limit for the storage or transmission of ions. In quadrupole rod systems this mass limit is sharply defined, but less so in higher multipole systems. The mass limit depends on the frequency and amplitude of the RF voltage. It is inversely proportional to the square of the frequency and linearly proportional to the amplitude. For a predetermined frequency, it is therefore the amplitude of the RF voltage which determines the lower mass limit. If light ions are also to be transmitted without losses, the amplitude of the RF voltage must be chosen so as to be small. The lower mass limit is given by the stability zone of the Mathieu differential equation for the motion of the ions in RF quadrupole fields. A pseudopotential cannot form for light ions because a pseudopotential requires an integration over several periods of the RF voltage, but these light ions are accelerated in just a half-period of the RF voltage to such a degree that they are either propelled out of the storage field in a single half-period, or they experience this propulsion by being excited increasingly in a few half-periods.

Electrons cannot be stored in conventional systems because their mass, which is only around 1/2000 of the mass of a proton, is far below the lower mass limits which can usually be set. The lower mass limit is usually set to between 50 and 300 daltons, and in rare cases lower.

The fact that quadrupole rod systems have an upper mass limit is less well known. The Mathieu differential equations state only that the restoring forces of the pseudopotential are smaller for heavy ions than for light ions. The restoring forces are proportional to the inverse z/m of the charge-related mass m/z of the ion. This means that light ions collect in the axis because the focusing pseudopotential is stronger for them, with higher filling rates heavier ions are forced to gather outside the axis, kept at a distance from the lighter ions by Coulomb repulsion.

When a quadrupole rod system is used as an ion storage device, the upper mass limit only makes itself felt during the injection and if the rod system is overfilled. Even if the injection is only slightly oblique, the weak pseudopotential for heavy ions can no longer deflect them back to the axis; they hit the pole rods or overcome the potential saddles of the spaces between the pole rods and are eliminated. If the system is overfilled, the space charge drives the heavy ions right up to the pole rods or over the potential saddles. If the quadrupole rod system is filled with a collision gas, there are two further components to consider: the thermal diffusion brought about by gas collisions, which can drive heavy ions out of the rod system because of the weak pseudopotential opposing field, and the collision cascades experienced by ions injected at high energy, whose lateral angles of deflection can randomly add up, with the result that the ions impact on the pole rods or can escape through the gap between the pole rods. Both effects result in considerable losses of heavy ions. Furthermore, heavy ions are discriminated if ions are axially ejected from the ion guide, because they are not in the axis.

The upper mass limit is not sharply defined, but it does attenuate the intensity of heavy ions to such a degree that they can no longer be readily detected by a mass spectrometer. The rule of thumb for a quadrupole rod system is that when an ion mixture is injected, the ions whose masses m/z are greater than twenty times the lower mass limit are attenuated by losses to such a degree that they can no longer be readily measured, especially no longer true to concentration. These heavy ions can even disappear completely, depending on the mixture of the ions in the quadrupole rod system.

The existence of the upper mass limit is already inconvenient in the field of peptide analysis in proteomics. The aim here is to measure not only the ions of individual amino acids, the so-called "immonium ions", but also the mass range of the so-called digest peptides up to around 5000 daltons. But if the lower mass limit for the measurement of the immonium ions is set to around 50 daltons, the rule of thumb states that this results in an upper mass limit of around 1000 daltons, which is completely unacceptable for this type of analysis. This means that time-of-flight mass spectrometers with orthogonal ion injection, which are employed particularly because of their high mass range, cannot be adequately used.

One solution is to use hexapole or octopole rod systems. These have more favorable pseudopotential distributions for heavier ions, with a steeper potential increase outside the axis in front of the pole rods, but with a flatter base of the potential well close to the axis. The pronounced pseudopotential minimum which exists in the axis of a quadrupole field does not exist here. However, this means that the ions do not collect as accurately in the axis of these systems and can thus no longer be injected as favorably into subsequent systems. The collision focusing is weaker. The operation of time-of-flight mass spectrometers with orthogonal ion injection suffers from a poorer resolution because the required fine cross-section of the ion beam can no longer be achieved.

Particularly in octopole rod systems, if the system is filled with a large quantity of ions, the heavier ions may collect far outside the axis, very close to the rods, because they are driven thereto by the space charge. This charge-dependent distribution of the ions in the interior is very unfavorable. It can even occur when there are no light ions at all in the ion mixture; the pure Coulomb repulsion between the heavy ions is sufficient. The ions collect on the surface of a cylinder; no collision focusing takes place at all if a limit ion density is exceeded.

Similarly, the limited mass range is unfavorable for those multipole systems in which reactions between very light negative reactant ions and heavy, multiply charged positive ions are to take place. In order to introduce the light reactant ions, the RF amplitude must be decreased to such an extent that losses of heavy ions occur. According to the current prior art, it is quite unfeasible to store heavy ions and electrons simultaneously.

There are publications concerned with the expansion of the mass range, in particular for ion guides. In these cases, attempts are made to force a stronger repulsion for heavy ions in the outer region near the pole rods. International Application WO 2001/013100 A2 discloses RF voltages with at least two frequencies are applied to a multipole rod system so that an RF field with lower frequency is generated in the immediate vicinity of the pole rods in order to drive the heavy ions back. Superimposed on this RF field is a quadrupolar RF field of higher frequency which collects light ions in the center. U.S. Pat. No. 7,595,486 describes how the usable mass range for the ions can be increased by giving the electrodes of rod systems a finer mechanical structure and by an appropriate electrical configuration.

A simultaneous storage of ions from extremely different mass ranges, for example electrons and heavy ions, is not remotely achievable with these measures.

There is a need for an arrangement with which, at least in radial direction, charged particles from extremely different mass ranges, for example electrons and heavy positive ions, can be retained in order to react with each other.

SUMMARY OF THE INVENTION

An ion storage system comprises an RF multipole rod system with at least eight pole rods and two RF generators, where at least one of the two RF voltages is supplied to only half of the pole rods at most in each case. The two RF voltages are connected to the pole rods so as to be uniformly distributed. In the multipole rod system, two multipole fields of different order independent of each other can then be generated around the axis. The multipole fields can be used separately or superimposed onto each other; in particular, multipole fields of different order can be switched between each other.

An aspect of the invention generates and superposes of two multipole fields of different order, completely independent of each other, in an RF multipole rod system, resulting in surprising new storage options. In an embodiment with eight pole rods, for example, it is thus possible to jointly store low-energy electrons in a central RF quadrupole field, which effectively acts only on electrons and holds them together radially, on the one hand, and multiply charged heavy positive ions in an RF octopole field, which effectively acts only on the ions, on the other hand, in order to fragment the positive ions by electron capture dissociation (ECD). In a different embodiment, multiply charged positive analyte ions and suitable negative reactant ions can react with each other in an octopole field by electron transfer dissociation (ETD) with a high fragment yield, and the fragment ions can subsequently be bundled by a transition to a quadrupole field to form a fine ion beam, which can leave the multipole rod system axially. A mixture of hexapole and dodecapole systems is also possible.

In a multiple rod system with eight pole rods, a quadrupole field near the axis and a broad octopole field can thus be superimposed on each other if four pole rods arranged in the shape of a cross are connected to a single-phase RF voltage for generating the octopole field, while the other four pole rods are connected crosswise to the two phases of a two-phase RF voltage for generating the quadrupole field. Since frequency and amplitude can be set for both fields independently of each other, surprising effects which have not been thought possible until now can be generated in this ion storage system.

An embodiment of the ion storage system with eight pole rods permits, for example, joint radial storage of, on the one hand, low-energy electrons in an RF quadrupole field with a frequency of about 200 megahertz and an amplitude of about 100 volts, which effectively acts only on the electrons and holds them together radially near the axis; and, on the other hand, multiply charged heavy positive ions in an RF octopole field with a frequency of about 1 megahertz and an amplitude of about 500 to 1000 volts, which effectively acts only on the ions. This means that the positive ions can be fragmented by electron capture dissociation (ECD).

In addition to solving this primary problem, an aspect of the invention can also solve further as yet unresolved problems. For example, in a different embodiment of the ion storage system, multiply charged heavy positive analyte ions and suitable arbitrarily light negative reactant ions can react with each other by electron transfer dissociation (ETD) in a pure octopole field. The introduction of ions into such pure octopole fields is particularly simple, and the reactions produce a particularly high yield of fragment ions, far more than in conventional quadrupole reaction cells. The unfavorable spatial distribution of the fragment ions can subsequently be changed by a transition from the octopole field to a quadrupole field; the ions can thus be bundled to a fine ion beam, as required for analysis in a time-of-flight mass spectrometer with orthogonal ion injection (OTOF), for example.

A mixture of higher multipole fields is also possible; thus hexapole and dodecapole fields can be set up, individually or mixed, in a multipole rod system with 12 pole rods. In general, multipole fields of the order of 2n and 4n can be generated, separately or mixed, in multipole rod systems with 4n pole rods. The pole rods can be arranged in a circle about the axis, but also in other, preferably regular, patterns. Each arrangement requires a two-phase RF voltage and a further RF voltage, which can be single-phase or two-phase. For certain applications, the multipole rod system can also be operated with a magnetic field parallel to the axis. The ions, some of which have differing polarities, can be trapped by terminal electric barriers, for which real electric fields or pseudo force fields, or mixtures of both, can be used. Injection and extraction of the ions can be effected by electric fields, by space charge effects, and in particular also by flows of the damping or collision gas.

These and other objects, features and advantages of the present invention will become more apparent in light of the following detailed description of preferred embodiments thereof, as illustrated in the accompanying drawings.

BRIEF DESCRIPTION OF THE DRAWING

In FIG. 4*a*, a quadrupole field is generated by supplying four pole rods with the two phases of a two-phase RF voltage; but in contrast to FIG. 2, the quadrupole field here only exists near the center. The potential saddles, which in FIG. 2 are located precisely between the pole rods, are shifted here toward the axis and reduce the size of the trapping region, the latter being characterized by a centripetal force acting on the ions. Despite this, a well-shaped quadrupole field forms in the vicinity of the axis. In FIG. 4*b*, the single-phase RF voltage at the four diagonally arranged pole rods generates an octopole field, whose potential distribution is identical to that of the octopole field in FIG. 2. It must be noted, however, that in the axis of the rod system, the potential with respect to ground oscillates up and down with the frequency of the RF field, but with half the amplitude of the applied voltage. This has no effect on the storage of the ions, however; this fluctuation must only be taken into account when ions are being injected.

Figure 3:
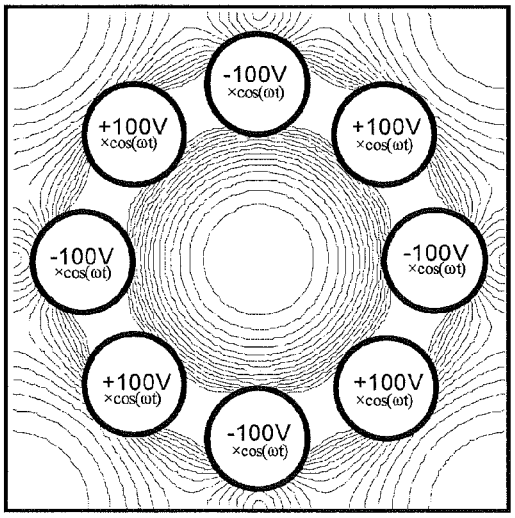
Figure 3 (Prior Art)
FIG. 3 shows the pseudopotential in the prior art of an octopole field between eight round pole rods: the pseudo force field increases to the third power here, the pseudopotential to the fourth power in all radial directions. The pseudopotential well is very shallow and exerts only a small centripetal force on the ions near to the center of the shallow well. The round pole rods mean that there are potential saddles between the pole rods here also; they can be removed by using hyperbolic pole rods, similar to FIG. 1.
Figure 4A:
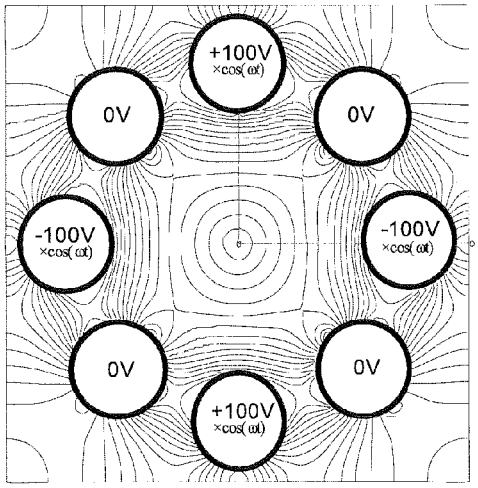
FIGS. 4*a* and 4*b* show the two potential distributions which can be generated in a rod system with eight pole rods according to an aspect of the invention and which can be superimposed independently of each other.
Figure 7:
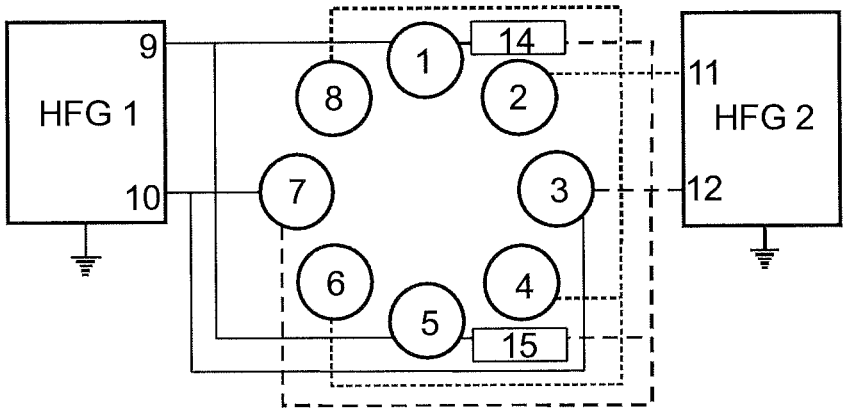

FIG. 7 illustrates an arrangement where the axis potential is constant in time. The second RF generator HFG2 here also supplies the two outputs with a two-phase RF voltage, whose two phases are connected round the circle to all the pole rods 1 to 8. The potential distributions from FIGS. 4*a* and 3 are superimposed here. This arrangement has the advantage of a constant axis potential; but the outputs of the RF generators must be decoupled from the respective RF voltages of the other generator. Choking coils 14 and 15 ensure that there is no short-circuit of the phases of RF generator HFG 1 supplied via the connections 9 and 10.

Figure 6:
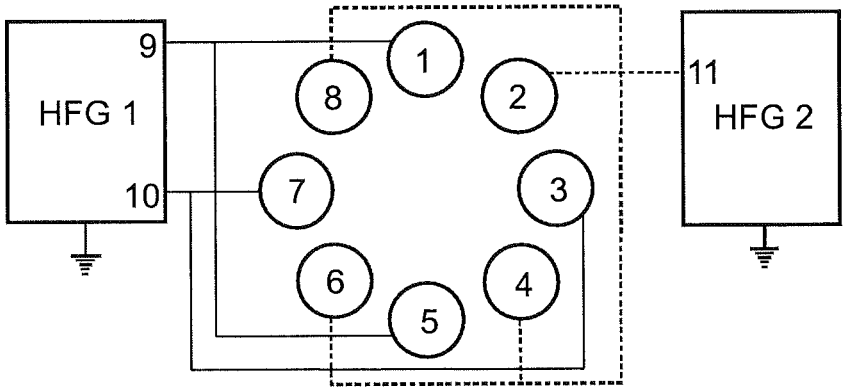
FIG. 6 depicts the arrangement of the ion storage cell with eight pole rods 1-8 and two high frequency generators HFG 1 and HFG 2. The RF generator HFG 1 supplies the outputs 9 and 10 with a two-phase RF voltage, whose two phases are connected to the pole rods 1 and 5, and 3 and 7 respectively. The second RF generator HFG 2 supplies the output 11 with a single-phase RF voltage, which is connected to the pole rods 2, 4, 6 and 8. This generates potential distributions, like those shown in FIGS. 4*a* and 4*b*. A potential corresponding to half the voltage of RF generator HFG 2 exists in the axis of the rod system. This high-frequency oscillating axis potential is irrelevant for the storage of the ions, but it is important for the injection of ions, and must therefore be taken into account by special measures.
Figure 8:
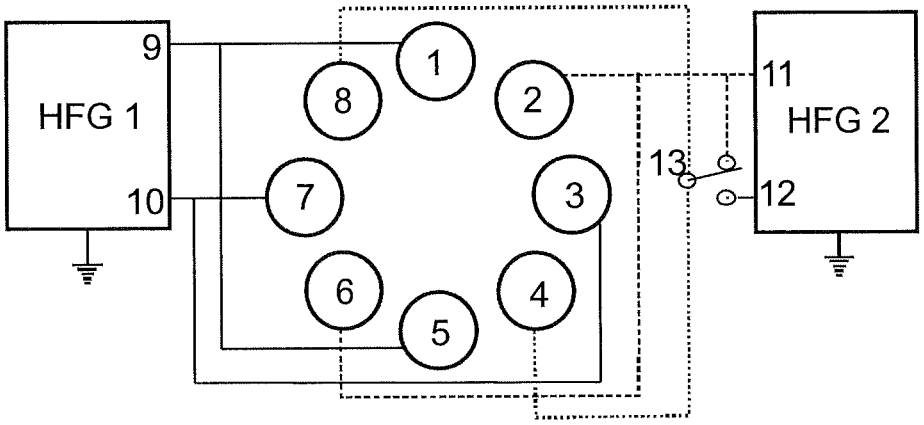

FIG. 8 shows in comparison to the circuit in FIG. 6, how the octopole field can be converted into a quadrupole field with the aid of a two-phase RF generator HFG 2 and an additional switch 13. The axis potential is also simultaneously switched so as to be constant in time.

Figure 9:
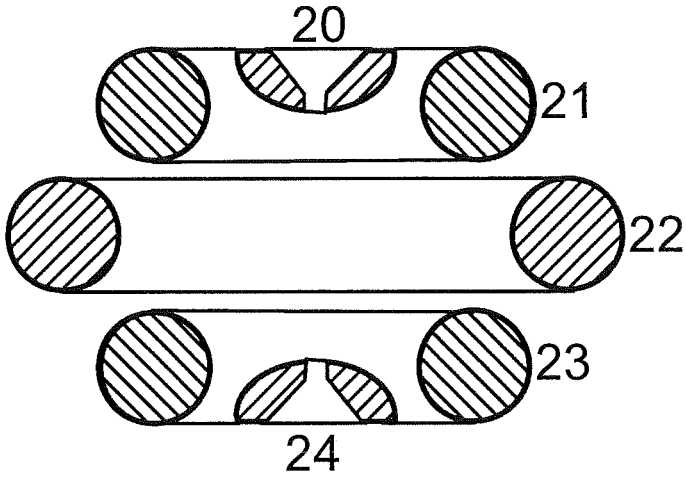

FIG. 9 illustrates a three-dimensional RF ion trap with two end cap electrodes 20 and 24, which have apertures for the injection and ejection of the ions, and three ring electrodes 21, 22 and 23 for the generation of separate quadrupole and octopole fields within the ion trap.

Figure 10:
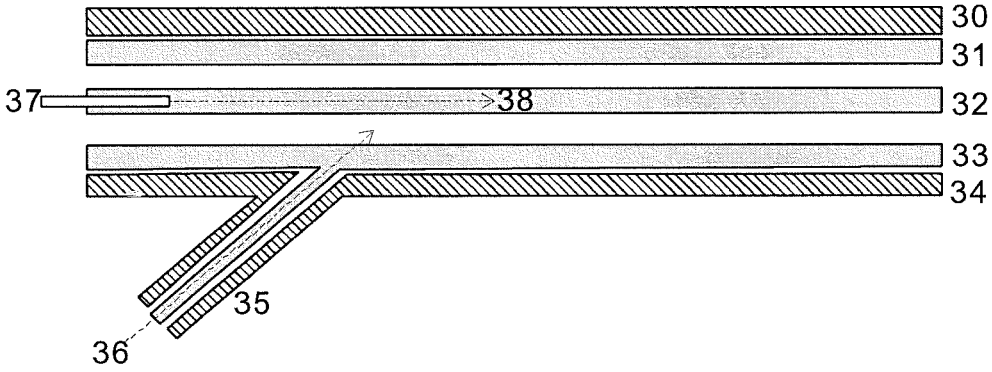

FIG. 10 shows a longitudinal section through a rod system with eight pole rods, of which the pole rods 30 and 34 are shown sectionally and the pole rods 31, 32 and 33 are visible in the background, with a lateral quadrupole feed 35 for heavy ions 36 into an octopole field, and with an electron generator 37 for the generation of electrons 38, which are trapped in a quadrupole field of very high frequency.

Figure 11:
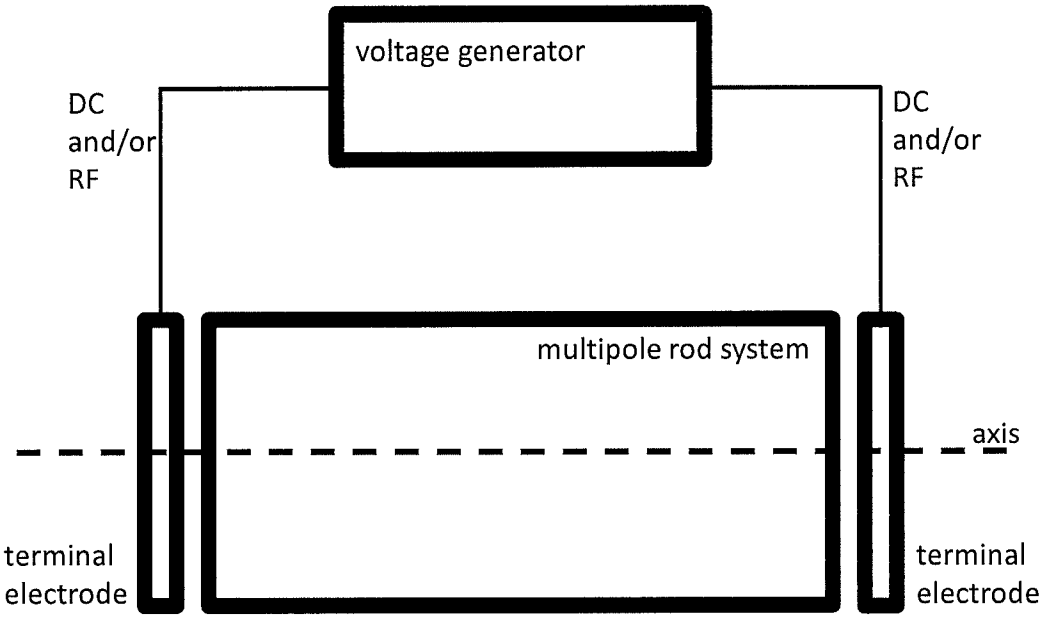

FIG. 11 is a block diagram illustration of an ion storage system that includes a voltage generator that supplies terminal electrodes with voltages.

Figure 12:
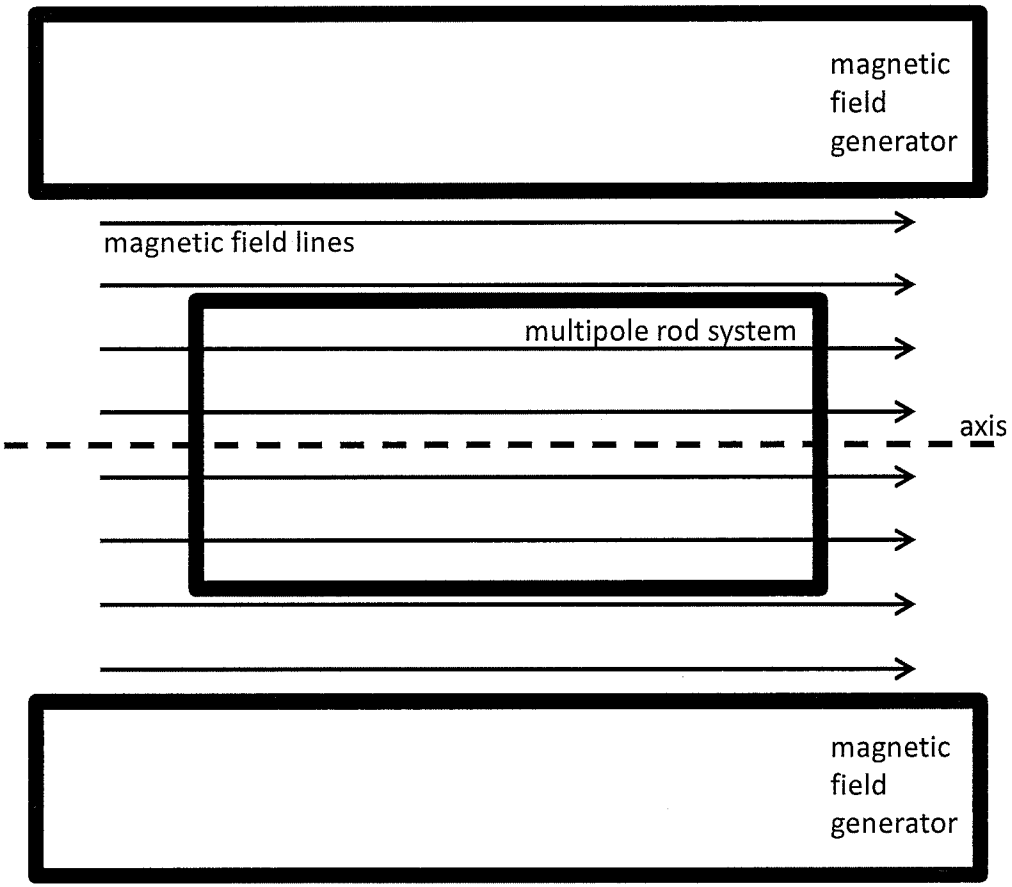

FIG. 12 is a block diagram illustration of an ion storage system that includes a magnetic field generator which generates an axially oriented magnetic field in the rod system.

DETAILED DESCRIPTION OF THE INVENTION

An ion storage system which comprises an RF multipole rod system with at least eight pole rods and two RF generators, where at least one of the two RF voltages is supplied so as to be distributed uniformly to only half of the pole rods in each case. One of the two RF voltages supplied has two-phase; the other can be single-phase with respect to ground potential. It is possible to set frequencies and amplitudes independently of each other. With this ion storage system, surprising effects can be generated which have not been thought possible until now.

In one of the embodiments of the ion storage system with eight pole rods, it is possible to store low-energy electrons and multiply charged heavy positive ions together, for example. To achieve this, an RF octopole field with a frequency of 1 megahertz and an amplitude of 1000 volts, which effectively acts only on the ions, is superimposed on an RF quadrupole field with a frequency of 200 megahertz and an amplitude of 100 volts, which effectively acts only on the electrons and holds them together radially near the axis. This method solves the problem of simultaneously storing charged particles whose mass ratio is larger than a million. In a multipole rod system with precisely eight pole rods, the near-axis quadrupole field according to FIG. 4*a* and the broad octopole field according to FIG. 4*b* can be superimposed independently of each other. As is depicted in FIG. 6, the four diagonally arranged pole rods 2, 4, 6 and 8 are connected to the single-phase RF voltage of the RF generator HFG2 for the generation of the octopole field, while the four other pole rods 1, 3, 5 and 7 are connected cross-wise to the two phases of the RF generator HFG 1 for the generation of the quadrupole field. In such an arrangement the multiply charged positive ions can be fragmented by electron capture dissociation (ECD).

Simulations have confirmed that simultaneous radial storage of electrons and heavy ions is possible. There is still the problem of the simultaneous axial storage of both species of particle. However, since electrons can be produced in large excess, it is possible to use a continuous flow of electrons without there being axial barriers for the electrons, for example.

If electrons are to be introduced axially into this arrangement, care must be taken that the real potential on the axis oscillates with the frequency of the RF voltage for the octopole field. This can be done, for example, by applying an RF voltage which has the same frequency and amplitude as the axis potential to the electron source. The electron source can be a hairpin thermionic cathode, for example; but it is also possible to use other ways of producing free electrons, such as the photoelectric effect. In order to achieve electron capture dissociation, there are two windows for the kinetic energy of the electrons: one window from about zero to three electronvolts, and one window at around 12 to 15 electronvolts.

The electrons can be introduced axially into the multipole rod system or be generated on the axis, as is indicated in FIG. 10. The figure shows a longitudinal section through a rod system with eight pole rods, of which the pole rods 30 and 34 are shown sectionally and the pole rods 31, 32 and 33 are visible in the background. The pole rod system has a lateral quadrupole feed 35 for heavy ions 36, which are introduced into an octopole field. Such lateral ion feeds are known from U.S. Pat. No. 7,196,326 B2 and German Patent Application DE 10 2011 108 691, for example. In the axis of the rod system there is an electron generator 37 to generate electrons 38, which are trapped in the high-frequency quadrupole field. The electrons can be produced by a hairpin thermionic cathode or by a photoelectron emitter, for example. Such a storage cell can be used for electron capture dissociation in continuous flow.

Electrons are introduced by irradiating one of the inner electrode surfaces across a large area with a nanosecond-pulse laser in order to produce photoelectrons. If the radiation impacts on one of the octopole electrodes in an advantageous phase of the RF voltage for the octopole field, for example +100 volts before the zero crossing of this RF voltage, the electrons can be accelerated with some energy into the vicinity of the axis and can collect there in the quadrupole field before the octopole field removes them from the cell. If the ion storage cell is filled with helium as the damping gas, the electrons can be accelerated to an energy of about 25 electronvolts by the field at the electrode without causing an ionization of the damping gas. The field drops to zero volts in around 100 nanoseconds. The electrons are able to overcome the barrier of the pseudopotential in front of the octopole electrode (see FIG. 4*a*), lose their kinetic energy through collisions and collect close to the axis. This type of electron generation within the ion storage device means the electron capture dissociation can be also operated in the continuous flow of analyte ions. For the generation of photoelectrons, also one of the pole rods for the generation of the quadrupole field can be used.

A further type of electron generation within the storage cell uses a suitable gas which includes of molecules, or at least contains molecules, which are easily ionized with light radiation by the emission of an electron. These molecules can be ionized with suitable light radiation, from a laser, for example. Both single-photon and two-photon processes can be used for this purpose. With two-photon processes, suitable focusing can restrict the electron generation to locations in the vicinity of the axis. It is particularly favorable if the positive ions thus generated have a mass which is below the storage threshold for the octopole field; this causes these ions to be automatically removed from the storage cell. The gas can also act as a damping gas in addition to its function as the source of photoelectrons.

The axis potential oscillating at RF frequencies can make it difficult to store ions. An arrangement where the axis potential is constant over time is therefore preferable for the purpose of storing the ions. Such an arrangement is shown in FIG. 7. Here the second RF generator also supplies a two-phase RF voltage, whose two phases are now connected round the circle to all the pole rods 1 to 8. Some of the voltage feeds must be equipped with choke coils 14 and 15 in order not to generate short-circuits for the voltages of the other RF generator. This arrangement is superimposed on the potential distributions of the FIGS. 4*a* and 3; it must be noted that the octopole fields of FIGS. 3 and 4*a* have completely the same effect on ions within the storage cell, but the octopole field in FIG. 3 can be filled more easily with electrons and ions from the outside.

After successful electron capture dissociation, the fragment ions should preferably be collected in the axis of the rod system in order to exit from the storage cell as a fine ion beam. This secondary task can also be fulfilled if the frequency of the quadrupole field is now reduced from 200 megahertz to around 1 megahertz, either by electrical adjustment or, if applicable, by switching to another high-frequency generator, this quadrupole field will collect the product ions of the reactions, in addition to the unused analyte ions, in a fine ion string on the axis. The octopole field here can remain switched on or be switched off; it must always be switched off if the axis potential oscillates at RF frequencies. On leaving the storage cell, a fine ion beam can be formed from the fine ion string, as is required for time-of-flight mass spectrometers with orthogonal ion injection (OTOF), for example.

Figure 4B:
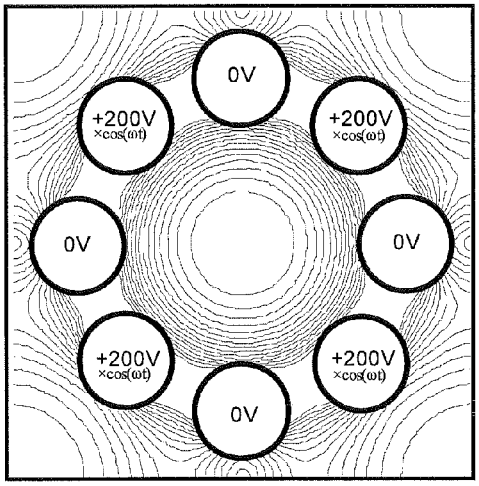

It is also possible to switch the octopole field in FIG. 4*b* into a quadrupole field after the reactions have finished, as is made possible by the configuration in FIG. 8. Compared to the circuit in FIG. 6, the octopole field of around one megahertz can be converted into a quadrupole field with the aid of a two-phase RF generator HFG 2 and an additional switch 13. The 200 megahertz quadrupole field for the storage of the electrons can be retained or not retained here. The axis potential is automatically switched to be constant in time so that favorable conditions exist for the formation and extraction of a fine ion beam.

These configurations according to FIGS. 6, 7 and 8 are only examples; many other configurations can be used within the framework of this invention. It is thus possible to initially generate a pure octopole field with constant potential on the axis with the aid of appropriate changeover switches, as depicted in FIG. 3, which is advantageous for filling with heavy ions. Switching over then generates an octopole field in accordance with FIG. 4*b* with an axis potential oscillating at RF frequencies. After superimposing a 200 megahertz quadrupole field, electrons can be introduced. After the reactions, the octopole field is converted into a quadrupole field with the aid of a further switch-over, similar to FIG. 8, in order to bundle the product ions on the axis.

In a different embodiment of the ion storage system, it is possible to let multiply charged heavy positive analyte ions react with suitable, arbitrarily light negative reactant ions to achieve electron transfer dissociation (ETD) in a pure octopole field. It is particularly simple to introduce ions into such pure octopole fields, especially if a configuration in accordance with FIG. 7 is used. The pure octopole field in itself provides a large mass range, and the reactions here demonstrate a particularly high yield of fragment ions, far higher than in conventional quadrupole reaction cells. The spatial distribution of the fragment ions in the octopole field is, however, unfavorable for subsequent use. This unfavorable spatial distribution of the fragment ions can subsequently be changed by a transition from the octopole field to a quadrupole field; the ions can thus again be bundled to form a fine ion beam, as is required for analysis in a time-of-flight mass spectrometer with orthogonal ion injection (OTOF), as described above.

It is also easy to carry out a collision-induced fragmentation (CID) of heavy ions in the octopole field.

The invention also makes it possible to superimpose higher multipole fields on each other; for example, hexapole and dodecapole fields can be set up, individually or mixed, in a multipole rod system with 12 pole rods. In general, multipole fields of the order of 2n and 4n can be generated, separately or mixed, in a multipole rod system with 4n pole rods. It is possible to superimpose a quadrupole field and a hexadecapole field in a multipole rod system with 16 pole rods, for example.

Figure 1:
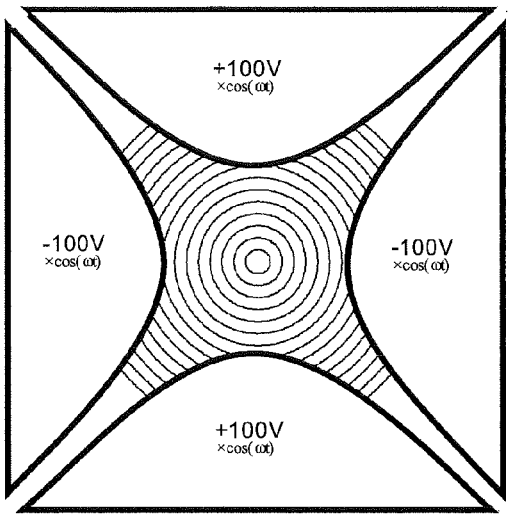
Figure 1 (Prior Art)
FIG. 1 shows equipotential surfaces of the pseudopotential in an ideal/prior art quadrupole field between hyperbolically shaped electrodes. The equipotential surfaces are graded so that uniform separations show the same increases in the strengths of the pseudo force field: it can be seen that the pseudo force field increases uniformly and linearly in all radial directions. The pseudopotential increases quadratically in these directions. In this potential well, the ions can oscillate harmonically through the axis or orbit or tumble around the well.
Figure 2:
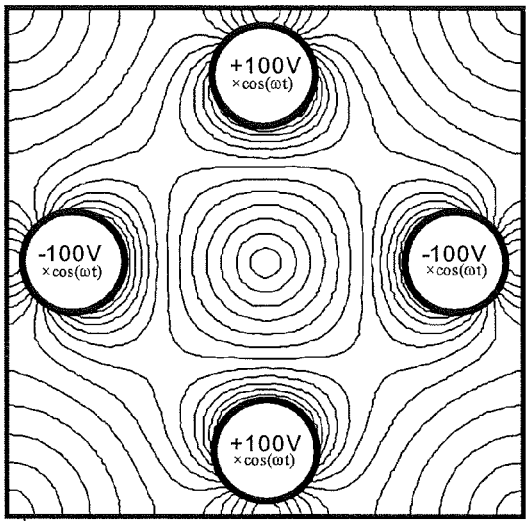
Figure 2 (Prior Art)
FIG. 2 illustrates how the pseudopotential is distorted in the prior art when the pole rods are round: precisely between the pole rods, there are potential saddles of the pseudopotential, which reduce the arrangement's radial holding force for ions when compared to hyperbolic pole rods. The potential saddles are lower than the pseudopotential directly at the surface of the pole rods; it is therefore easier for ions to escape here than in the ideal quadrupole field according to FIG. 1. Nevertheless, quadrupole rod systems with round pole rods are very often used in ion guides and in reaction cells; the pole rods are usually chosen to be thicker than in this figure, however, and therefore a quadrupole field is formed which is somewhat closer to the ideal field of the hyperbolic pole rods.
Figure 5A:
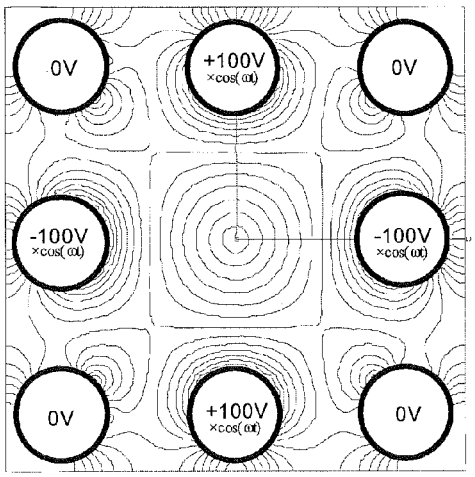
FIGS. 5*a* and 5*b* show how the capturing quadrupole field in the vicinity of the axis can be increased by a different arrangement of the pole rods without the octopole field changing significantly. The capture region for ions is now as large as in FIG. 2 for a quadrupole field with circular pole rods of small thickness. A square arrangement is chosen here; other arrangements are also possible.
Figure 5B:
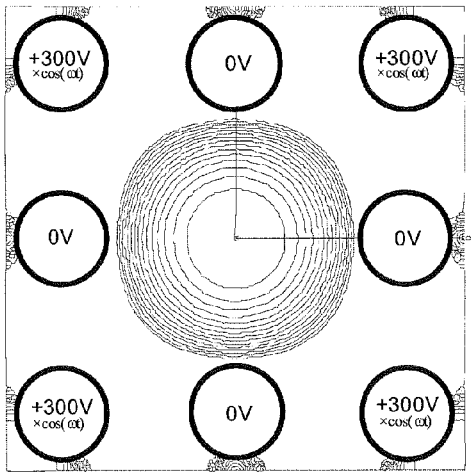

The pole rods can be arranged in a circle about the axis, as in FIGS. 4*a* and 4*b*, or in other, preferably regular, patterns. FIGS. 5*a* and 5*b* show a square arrangement of the eight pole rods, where the trapping region of the quadrupole field, as FIG. 5*a* shows, is considerably larger than the trapping region in the octagonal version in FIG. 4*a*. The trapping region of the quadrupole field here is as large as that in FIG. 2, which is formed by four pole rods, although these are thinner than usual. Adjusting the RF voltages means that the octopole storage is practically unchanged here, as the comparison of FIGS. 4*b* and 5*b* illustrates.

Two RF voltages are required for each arrangement, at least one two-phase voltage with respect to ground potential and a single-phase voltage, which can also be a two-phase one. These two RF voltages are also required for the generation of higher multipole fields. If the frequency of the quadrupole field is to be switched, for example from 200 megahertz to 1 megahertz, as has been described above, it may be expedient to use a third, two-phase RF generator.

In one embodiment, the multipole rod system can also be operated with a magnetic field parallel to the axis in order to promote an electron capture dissociation reaction between electrons and ions. In this case, a magnetic field generator must be provided at the ion storage cell.

The ions, some of which have differing polarities, can be trapped by terminal electric barriers, for which real electric fields or pseudo force fields, or mixtures of both, can be used. As usual in existing ion storage systems, injection and extraction of the ions can be achieved by electric fields, in particular by lowering the terminal barriers. During extraction, the ions may leave the storage device due to the effect of the space charge; but they can also be ejected by additional electric fields. A particularly elegant method drives the ions by flows of the damping gas.

An aspect of the invention thus generally relates to an ion storage system that comprises an RF multipole rod system with 4n pole rods (the integer n being larger than 1) and two RF generators, where the voltage outputs of at least one RF generator are connected to half of the pole rods at most. This RF generator supplies a two-phase RF voltage with respect to a ground potential; the RF voltage of the second RF generator can be single-phase, connected to the remaining pole rods.

A multipole rod system is preferred which comprises precisely eight pole rods, where one phase of the two-phase RF voltage is connected to two opposing pole rods, and the other phase is connected to two pole rods located crosswise to the former; and the single-phase RF voltage is connected to the remaining four pole rods, as shown in FIG. 6. Especially preferred is a multipole rod system of eight pole rods which are connected to two two-phase RF voltages, as shown in FIG. 7. This multipole rod system displays a constant potential on the axis and is easy to fill with charged particles.

In addition to the pole rods, the ion storage system usually also comprises terminal electrodes, with which the axially acting electric barriers are generated. A voltage generator can supply the terminal electrodes with voltages in such a way that the electric barriers are created which prevent ions from exiting. The barriers can include real electric potentials, pseudopotentials, or mixtures of both.

In a preferred embodiment, one RF generator supplies a two-phase RF voltage of a frequency about $\omega>100$ megahertz for generating the quadrupole field, while the other RF generator supplies an RF voltage of a frequency in the range of about $0.5<\omega<2$ megahertz for generating the octopole field. It is particularly favorable if the RF voltage for generating the quadrupole field can be switched from about $\omega>100$ megahertz to a frequency in the range of about $0.5<\omega<2$ megahertz, which may require a third RF generator.

For specific purposes, an axially aligned magnetic field can be superimposed on the ion storage system, for example in order to support specific reactions such as electron capture dissociation.

In a manner analogous to the multipole rod systems with eight pole rods, it is possible to use two RF generators to generate quadrupole and octopole fields of arbitrarily different frequencies in a three-dimensional RF trap with two end cap electrodes and three ring electrodes, as shown in FIG. 9. These fields can be used, separately or superimposed onto each other, for the storage of ions. Positive and negative particles of very different mass can also be stored here. Laser irradiation can also be used here to produce photoelectrons, which can be used for reactions with positive ions. The product ions can be pulsed out from the ion trap through openings in the end cap electrodes 20 or 24 and fed to an ion analyzer of any type, such as an ion cyclotron resonance cell (ICR), an electrostatic Kingdon mass analyzer or a time-of-flight mass spectrometer.

Although the present invention has been illustrated and described with respect to several preferred embodiments thereof, various changes, omissions and additions to the form and detail thereof, may be made therein, without departing from the spirit and scope of the invention.

What is claimed is:

1. An ion storage system comprising:

an RF multipole rod system that includes 4n pole rods, where n is an integer number larger than one, wherein the pole rods are supplied with RF voltages by a first RF generator and a second RF generator, where the first RF generator supplies a two-phase RF voltage, and the two phases of the first RF generator are each connected to at least two and at most n opposite pole rods, wherein the second RF generator supplies at least one of (i) a single-phase RF voltage, which is connected to the remaining pole rods, and (ii) a two-phase RF voltage, the two phases of which are connected round the circle to all the pole rods.

2. The ion storage system according to claim 1, wherein some feeds are provided with chokes to prevent short-circuits.

3. The ion storage system according to claim 1, comprising a multipole rod system with eight pole rods, wherein one phase of one RF generator is connected to two opposite pole rods and the other phase is connected to two pole rods located crosswise to the former.

4. The ion storage system according to claim 1, further comprising terminal electrodes for axial storage.

5. The ion storage system according to claim 4, further comprising another voltage generator which supplies the terminal electrodes with voltages in such a way that electric barriers are created which prevent ions from exiting.

6. The ion storage system according to claim 5, wherein the barriers include one of real electric potentials, pseudopotentials and mixtures of both.

7. The ion storage system according to claim 1, further comprising a magnetic field generator which generates an axially oriented magnetic field in the rod system.

8. The ion storage system according to claim 1, wherein the pole rods have one of circular round and hyperbolic shape.

9. The ion storage system according to claim 1, further comprising one of a time-of-flight mass spectrometer, an ion cyclotron resonance cell, and an electrostatic Kingdon mass analyzer, respectively located downstream from the ion storage system and receiving a finely bundled ion beam therefrom.

10. The ion storage system according to claim 1, wherein injection and extraction of ions into and from the ion storage system, respectively, is effected by one of electric fields, space charge effects, and gas flows.

11. The ion storage system according to claim 1, further comprising an electron source for providing electrons in the ion storage system used for electron capture dissociation (ECD).

12. The ion storage system according to claim 11, wherein the electron source is one of a hairpin thermionic cathode and photoelectron emitter.

13. The ion storage system according to claim 11, wherein the electron source produces ions within the ion storage system.

14. The ion storage system according to claim 1, wherein the pole rods are arranged in a regular pattern about a central axis.

15. The ion storage system according to claim 1, further comprising providing a collision or damping gas within the ion storage system.

16. An ion storage system comprising:

an RF multipole rod system that includes 4n pole rods, where n is an integer number larger than one, wherein the pole rods are supplied with RF voltages by a first RF generator and a second RF generator, where the first RF generator supplies a two-phase RF voltage, and the two phases of the first RF generator are each connected to at least two and at most n opposite pole rods, wherein one RF generator generates an RF voltage of a frequency about $\omega>100$ megahertz, and the other RF generator generates an RF voltage of a frequency in the range of about $0.5<\omega<2$ megahertz.

17. The ion storage system according to claim 16, wherein the frequency of one RF generator can be switched from a frequency about $\omega>100$ megahertz to a frequency in the range of about $0.5<\omega<2$ megahertz.

18. The ion storage system according to claim 16, wherein an octopole field can be switched to a quadrupole field with a frequency in the range of about $0.5<\omega<2$ megahertz by switching the RF voltages on two opposite pole rods to an opposing phase.

* * * * *